US009713563B2

(12) United States Patent
Mansur, Jr. et al.

(10) Patent No.: US 9,713,563 B2
(45) Date of Patent: Jul. 25, 2017

(54) MICRO BLEED HOLE CONNECTOR FOR USE IN INTERMITTENT PNEUMATIC COMPRESSION DEVICES

(71) Applicant: Compression Therapy Concepts, Inc., Eatontown, NJ (US)

(72) Inventors: Orlando Mansur, Jr., Eatontown, NJ (US); Leonard Nass, Eatontown, NJ (US)

(73) Assignee: Compression Therapy Concepts, Inc., Eatontown, NJ (US)

( * ) Notice: Subject to any disclaimer, the term of this patent is extended or adjusted under 35 U.S.C. 154(b) by 6 days.

(21) Appl. No.: 14/216,679

(22) Filed: Mar. 17, 2014

(65) Prior Publication Data

US 2014/0276285 A1 Sep. 18, 2014

Related U.S. Application Data

(60) Provisional application No. 61/786,405, filed on Mar. 15, 2013.

(51) Int. Cl.
*A61H 9/00* (2006.01)

(52) U.S. Cl.
CPC ... *A61H 9/0078* (2013.01); *A61H 2201/0173* (2013.01)

(58) Field of Classification Search
CPC ..... A61H 9/0078; A61H 2201/0173; A61H 9/0092; A61H 2209/00; F16L 55/07; A61F 13/085; A61B 17/135; A61M 39/10; A61M 39/1011
See application file for complete search history.

(56) References Cited

U.S. PATENT DOCUMENTS 4,317,471 A * 3/1982 King, Sr. ..... F16L 37/05 137/115.16
4,501,280 A * 2/1985 Hood, Jr. ..... A61B 5/02141 600/490
4,603,890 A * 8/1986 Huppee ..... F16L 33/30 285/14
5,123,840 A * 6/1992 Nates ..... A61C 17/043 285/7
5,487,571 A * 1/1996 Robertson ..... F16L 33/30 285/239

(Continued)

*Primary Examiner* — James M Hewitt
(74) *Attorney, Agent, or Firm* — Schwegman Lundberg & Woessner, P.A.

(57) ABSTRACT

A micro bleed hole connector for use in intermittent pneumatic compression devices includes a body made of a material that is sturdy, durable and compression resistant. The bleed hole connector resembles industry-standard air tube connectors, and has a micro bleed hose connecting its hollow lumen to the outside, ambient air. In use, the connector is inserted between the air input tube of an intermittent pneumatic compression device and an air supply tube, which is connected to an air pump. The air pump inflates and deflates the intermittent pneumatic compression device, which is placed on a patient's limb. In the event deflation of the compression device is retarded by air pump failure or air supply tube occlusion, the micro bleed hole dissipates air sufficiently to prevent injury to the patient's limb. Air dissipation through the bleed hole during normal operation is minimal and does not impact therapeutic application.

15 Claims, 3 Drawing Sheets

(56) References Cited

U.S. PATENT DOCUMENTS

| | | | | |
|---|---|---|---|---|
| 5,626,556 | A | 5/1997 | Tobler et al. | |
| 5,769,801 | A * | 6/1998 | Tumey | A61H 9/0078 601/150 |
| 5,813,702 | A * | 9/1998 | McGuire | E03C 1/102 137/216 |
| 5,947,954 | A * | 9/1999 | Bonaldo | A61M 39/22 604/248 |
| 6,308,992 | B1 * | 10/2001 | Mitsui | F16L 33/30 285/133.11 |
| 7,871,387 | B2 | 1/2011 | Tordella et al. | |
| 8,328,241 | B1 * | 12/2012 | Mortensen | F16L 33/30 285/239 |
| 2003/0167070 | A1 * | 9/2003 | McEwen | A61B 17/135 606/203 |
| 2005/0070828 | A1 | 3/2005 | Hampson | |
| 2005/0187499 | A1 * | 8/2005 | Gillis | A61H 9/0078 601/151 |
| 2005/0187500 | A1 * | 8/2005 | Perry | A61H 9/0078 601/152 |
| 2006/0096307 | A1 * | 5/2006 | Coogle | F16L 55/07 62/272 |
| 2008/0077176 | A1 * | 3/2008 | Hanlon | A61H 9/0078 606/201 |
| 2008/0245361 | A1 | 10/2008 | Brown | |
| 2008/0249441 | A1 | 10/2008 | Avitable | |
| 2008/0249442 | A1 | 10/2008 | Brown | |
| 2008/0249443 | A1 | 10/2008 | Avitable | |
| 2008/0249444 | A1 | 10/2008 | Avitable | |
| 2008/0249447 | A1 | 10/2008 | Brown | |
| 2008/0249449 | A1 | 10/2008 | Brown | |
| 2008/0249455 | A1 | 10/2008 | Brown | |

* cited by examiner

MICRO BLEED HOLE CONNECTOR FOR USE IN INTERMITTENT PNEUMATIC COMPRESSION DEVICES

This application claims the benefit of priority to U.S. Provisional Application No. 61/786,405, filed on Mar. 15, 2013, entitled "Micro-Bleed Hold Connector For Use in intermittent Pneumatic Compression Devices".

FIELD OF THE INVENTION

The present invention relates generally to medical and therapy devices. The present invention is more particularly useful as pneumatic medical and therapy devices which safely deflate should the air tubes of such devices become occluded or the air pumps fail. The present invention is particularly useful to prevent the tourniquet-like effects of persistent inflation of pneumatic medical and therapy devices created when the device's exit tubes become occluded during periods when a patient or attendant is unable to monitor proper function of the medical device.

BACKGROUND OF THE INVENTION

Within the field of medicine many different medical related tasks involve delivery and/or removal of air to and from a patient's medical device. A common example is a pneumatic compression device. The medical devices used in pneumatic compression typically require a direct connection from the air supply device to the device connected to the patient in the form of a tube. Depending on their intended use, the tube designs can vary in characteristics such as size (length, inner and outer diameter), hardness, flexibility, compressibility, and durability. These characteristics are dictated by the choice of material from which the tube is formed, with polyvinylchloride (PVC), polyurethane (PU), silicone and latex rubber being quite commonplace.

One of the most critical concerns whenever a tube is used in a medical device is that its lumen remains patent. If the lumen decreases or collapses, the transmission of the air slows or ceases, presenting in many circumstances a medical emergency or at least a situation of medical concern. Physical folding or compression of the tube can occlude the lumen quite easily in many situations.

In a majority of medical pneumatic device applications, a key characteristic of the tube is flexibility. It needs to be moveable and maneuverable to facilitate connection from the device to the patient, as device and patient location and position can vary widely. However, by increasing tubal flexibility, usually by adding plasticizers or other known additives, there is a softening effect in the composite material, which also increases compressibility, and thereby increases the occlusion potential of the tubal lumen. One way this occluding can happen is if the patient accidently compresses the device tube by lying on, sitting on, rolling over on, or by bending a segment of the flexible tubing too far, thus pinching the lumen closed. Manufacturing a thicker tube wall can help remedy these situations, but brings added cost and decreased tubal flexibility. Additionally, smaller diameter tubes still remain flexible and tend to have fewer problems associated with bending and compression of the lumen, but are not suited for all situations, especially those situations requiring the transfer of lower density fluids at higher flow rates, as in the case of air transmission.

Intermittent pneumatic compression therapy ("CPC") as a preventive treatment for deep vein thrombosis ("DVT") incorporates the use of flexible tubes transferring air from an air pump to inflate and deflate airtight garments wrapped around a patient's limb. The flexible tubes attach to the air pump and garment on the patient, via industry-standard tube connectors. The successive inflations and deflations of the garment simulate the series of compressions applied to the limb veins during normal muscle contractions, and thereby limit any blood stasis that could lead to the formation of clots ("thrombi"). IPC can be of benefit to patients deemed to be at risk of deep vein thrombosis during extended periods of inactivity, and is an accepted treatment method for preventing blood clots or complications of venous stasis in persons after physical trauma, orthopedic surgery, neurosurgery, or in disabled persons who are unable to walk or mobilize effectively. This technique is also used to stop blood clots from developing during surgeries that will last for an extended period of time.

Complications from use of the IPC device can arise particularly, if the airtight garments around the patient's limb do not deflate, leaving a prolonged state of increased pressure on the limb. This tourniquet-like effect can impede normal blood flow, and thus create other problems such as swelling and improper tissue oxygenation toward the end of the limb, as well as increasing the risk of thrombi formation. This improper deflation of the IPC garment can occur if the tube from the air pump to the inflatable garment is occluded, such as can happen if a patient accidentally lies or sits on the tube or the tube gets inadvertently compressed or bent as can happen when the patient is sleeping, for example. Another cause of improper deflation is failure of the air pump to release air from the tube. Some tubes in the industry are manufactured with a denser, less compressible material, usually metal, coiled within or lined the inside of their was to prevent collapse or occlusion of the tubal lumen. These tubes can be effective in restricting occlusion; however, they are significantly more complex in design and require more costly manufacturing and production processes.

In light of the above, it would be advantageous to provide a connector with a micro bleed hole that connects an air tube to the IPC garment on the patient, and safely allows deflation of a medical or therapy device in the event such device fails due to an occluded air tube or inoperative air pump. It would be further advantageous to provide a connector with a micro bleed hole that is easily manufactured from current industry-standard connectors occurring in a variety of sizes and styles that can be easily inserted into tubes of the types and grades already commonly used in the medical and therapy industries. It would also be advantageous to provide a micro bleed hole connector for medical and therapy device air tubes that is easy to use and customize, relatively easy to manufacture, and comparatively cost efficient.

SUMMARY OF THE INVENTION

The micro bleed hole connector for use in intermittent pneumatic compression devices (hereafter referred to as "bleed hole connector") of the present invention includes a connector designed to provide an airtight connection between a flexible air supply tube and an inflatable compression garment on a patient. A standard air tube connector connects the air supply tube to an air supply pump. The bleed hole connector of the present invention has a solid body with a patent lumen, which conducts the air to and from the compression garment on the patient. A small hole within the body wall of the bleed hole connector of the present invention provides a passageway linking the airtight lumen of the connector with the outer atmosphere. This hole allows air to escape from the compression garment should its deflation be prevented by an occlusion of the flexible air tube or failure of the air pump air release mechanism.

One application of the bleed hole connector of the present invention is in an intermittent pneumatic compression ("IPC") therapy device used for the prevention of deep vein thrombosis ("DVT"). An IPC device consists of an air pump, a compression garment that wraps around a patient's limb, and one or more medical-grade air tubes that connect the pump to the garment. The pump forces air through the air tube to inflate and deflate the compression garment, thereby assisting in moving blood through the limb to prevent stasis and risk of DVT. The air tube is connected to the pump and garment via connectors standard in the industry, such as Colder® brand APC connectors that utilize a male-female connection format for ease in connecting and disconnecting the tube from the IPC compression garment.

In use, one end of the bleed hole connector of the present invention is inserted lengthwise into the lumen of a flexible air supply tube. If a quick-disconnect configuration with male-female connectors is utilized, the male bleed hole connector is inserted into the female tube connector, which is inserted into the aft supply tube lumen. The opposite end of the bleed hole connector is inserted into the input tube of the IPC device garment attached to the patient's limb. As a result a connection between the air pump and the compression garment wrapped around a patient's limb, the operation of the IPC device begins with its timed cycles of inflations and deflations.

It is to be appreciated that a small amount of air is continuously dissipated through the bleed hole in the bleed hole connector of the present invention during inflations and deflations. Specifically, a small portion of the air passing through the lumen of the bleed hole connector passes from the interior of the lumen, through the bleed hole, to the ambient atmosphere. The effect of this air loss during inflations is insignificant in that it does not slow or prevent the proper, complete inflation of the IPC garment on the patient's limb nor does it prevent the garment from achieving maximum pressure and therapeutic compression of the patient's limb.

The length, shape, general size and material of the bleed hole connector of the present invention and the diameter of the micro bleed hole in the connector are determined by the medical or therapy device tube characteristics as well as those of a particular application and device garment. The proper determination of these characteristics for the given application is known to those skilled in the art.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF A PREFERRED EMBODIMENT

Figure 1:
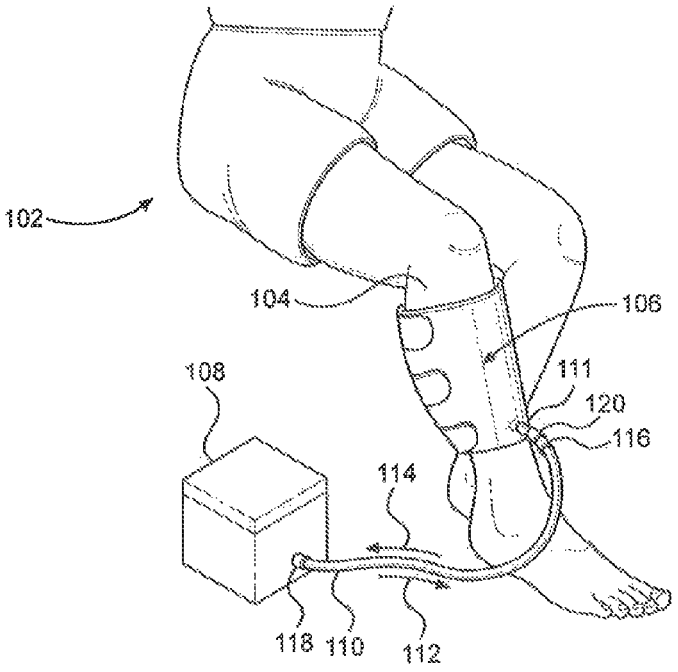
FIG. 1 is a diagrammatic view of a preferred application for the preferred embodiment of a micro bleed hole connector of the present invention showing an IPC therapy device for the prevention of DVT with an air pump connected via a flexible, hollow air tube to a compressive garment on a patient.

Referring initially to FIG. 1, a diagrammatic view of a preferred application for a bleed hole connector of the present invention is shown. In FIG. 1, a preferred embodiment of a bleed hole connector of the present invention is depicted and designated 120. Specifically, an IPC therapy device for the prevention of DVT consisting of an air pump 108 connected via a flexible, hollow air supply tube 110 to a compressive garment 106 positioned on the lower leg 104 of patient 102, is shown. Air supply tube 110 attaches to pump 108 via an industry-standard connector 118 and to an input tube 111 of compressive garment 106 via an industry-standard quick-disconnect connector 116. Flexible air supply tube 110 also attaches to the micro bleed hole connector 120 of the present invention.

The IPC therapy device configuration is known in the industry. Pump 108 inflates and deflates compressive garment 106 by supplying pressurized air through flexible air supply tube 110 in directions 112 and 114, respectively. Flexible air supply tube 110 is made of common medical-grade tubing known in the industry, and is relatively transparent.

Figure 2:
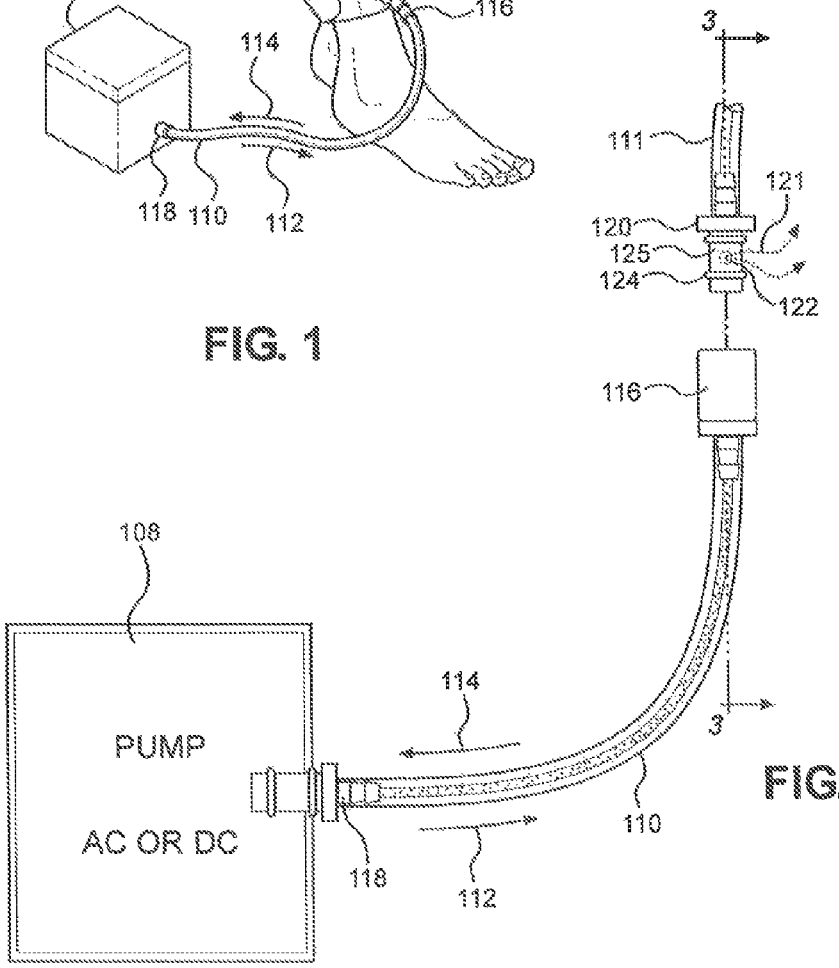
FIG. 2 is an enlarged view of the IPC therapy device air pump connected to the flexible, hollow air tube using a standard aft tube connector at the air pump end and the preferred embodiment of the micro bleed hole connector (shown as expanded from the standard female connector portion) of the present invention at the compressive garment end of the tube.

FIG. 2 is an enlarged view of the air pump 108 and flexible air supply tube 110 of the IPC therapy device shown in FIG. 1. Flexible air supply tube 110 is equipped with quick-disconnect connectors 116 and 118 known in the industry to facilitate the changing of multiple devices, such as compressive garment 106, with air pump 108. In a preferred application, quick-disconnect connector 116 is a female sub-type, and connects to the input tube 111 of compressive garment 106 (shown in FIG. 1) by sliding over a micro bleed hole connector 120 of the present invention, which is a male-subtype having a tubular central body 125. Both, quick-disconnect connector 116 and the micro bleed hole connector 120, have an industry standard hose barb coupling 115 (shown in FIG. 3) at one end by which they are connected to air supply tube 110 and input tube 111, respectively. A seal is made between the body of female quick-disconnect connector 116 and the male bleed hole connector 120 of the present invention by an O-ring 124 positioned around the outside central body 125 of the bleed hole connector 120.

A micro bleed hole 122 in the central body 125 of the bleed hole connector 120 of the present invention allows a small amount of air to escape from the bleed hole connector 120 during periods of inflation and deflation in air flow directions 112 and 114, respectively. For clarity, directional arrows 121 depict the typical airflow from the micro bleed hole 122, and are seen in more clarity in cross-sectional view in FIG. 3. A small portion of the air passing through the lumen of the bleed hole connector 120 passes from the interior of the lumen formed in the connector, through the bleed hole, to the ambient atmosphere as depicted by airflow arrows 121.

Flexible air supply tube 110 is shown having a non-descript length. It is to be appreciated that the length of the air supply tube 110 may vary depending on the particular field of use, and the setting. For instance, in a hospital surgery setting, it may be difficult to position an air source immediately adjacent to the patient when an extended air supply tube 110 is required.

The bleed hole connector 120 of the present invention must be durable, compression resistant, and able to maintain a relatively tight connection under the air pressures of the given application. It must also be relatively easy to use. Industry-standard materials meeting these criteria and in common use include plastic polymers such as acetal copolymer and homopolymer, nylon, polypropylene and polycarbonate, as well as metals such as zinc, brass and stainless steel. Additionally, physical design styles of some industry-standard connectors include male-to-female and straight configurations having hose barb or threaded connections to the medical device air tubes.

It is to be appreciated that to those skilled in the art there may be materials and manufacturing processes known, as well as shapes of bleed hole connector 120, which might be most advantageous for a given patent application.

Figure 3:
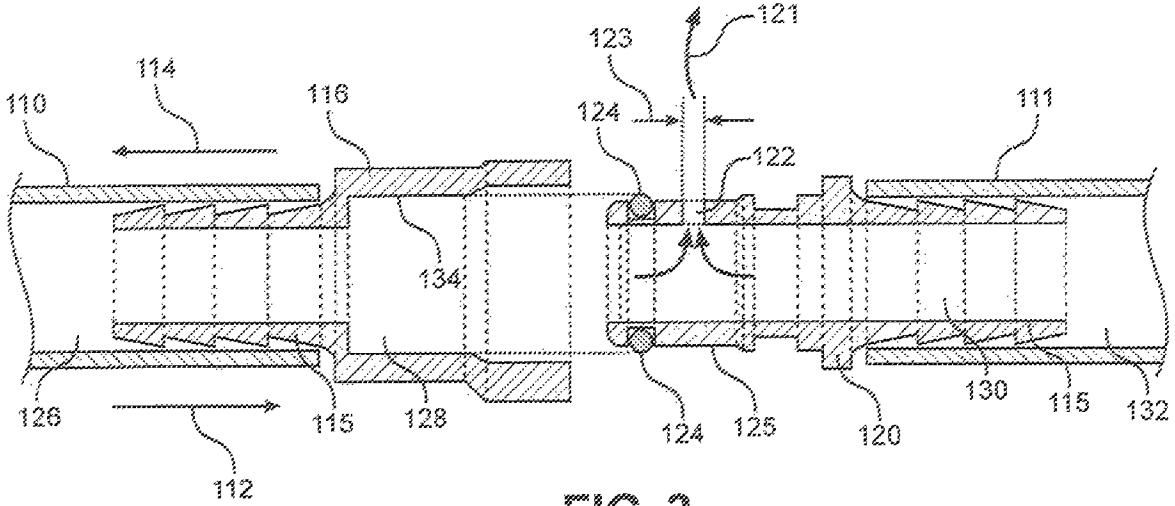
FIG. 3 is a cross-sectional view of the air tube of the IPC therapy device and the preferred embodiment of the micro bleed hole connector (shown as expanded from the standard female connector portion) of the present invention as taken along line 3-3 of FIG. 2.

Referring now to FIG. 3, a cross-sectional view of the bleed hole connector 120 of the present invention and its mating female connector 116 as taken along line 3-3 of FIG. 2 is shown. For clarity, bleed hole connector 120 and female quick-disconnect connector 116 are shown expanded apart from each other. Air supply tube 110 is attached to female quick-disconnect connector 116 by an industry standard hose barb section 115 of the female quick-disconnect connector 116. Female quick-disconnect connector 116 has an inner body wall 134 that circumscribes a lumen 128, which communicates directly with a lumen 126 of air tube 110 and a lumen 130 of bleed hole connector 120.

Air input tube 111 of compression garment 106 (shown in FIG. 1) connects to the bleed hole connector 120 of the present invention also by a hose barb section 115 of the bleed hole connector 120 allowing communication between a lumen 132 of air input tube 111 and lumen 130 of the bleed hole connector 120. The micro bleed hole 122 of the bleed hole connector 120 of the present invention is shown connecting inner lumen 130 of bleed hole connector 120 with the outer atmosphere. Micro bleed hole 122 has a diameter 123.

During normal operation, bleed hole connector 120 is positioned completely within lumen 128 of female quick-disconnect connector 116. The O-ring 124 of bleed hole connector 120 seats snugly against the inner body wall 134 of female quick-disconnect connector 116 and forms a relatively airtight seal between the female quick-disconnect connector 116 and the bleed hole connector 120. Air coming from the air pump 108 (shown in FIGS. 1-2) during inflation or from the compressive garment 106 during deflation passes through the mated connectors 116 and 120. Inner body wall 134 of female quick-disconnect connector 116 covers, but does not occlude micro bleed hole 122 when bleed hole connector 120 is fully inserted into female quick-disconnect connector 116. Some air escapes through bleed hole 122 into the ambient, or atmosphere, and is shown for clarity, by arrows 121. The size of diameter 123 determines how much air dissipates through the bleed hole 122. It is to be appreciated that if the diameter 123 is too small, then deflation of compressive garment 106 may occur too slowly in the event of an occlusion of air tube 110 or failure of air pump 108. This could lead to blood stasis and subsequent harm to the patient's limb 104 due to a tourniquet-like effect. Also, if the diameter 123 of bleed hole 122 is too large, too much air dissipates and air pump 108 may not be able to achieve and maintain sufficient air pressure in compressive garment 106 to be therapeutic. Determination of the size of diameter 123 is application specific and known to those skilled in the art.

Figure 4:
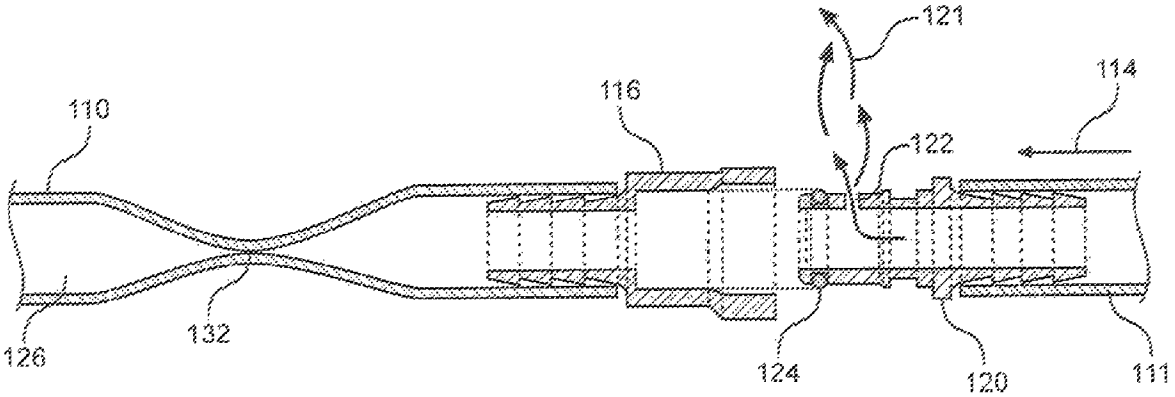
FIG. 4 is a cross-sectional view of the air tube of the IPC therapy device and the preferred embodiment of the micro bleed hole connector (shown as expanded from the standard female connector portion) of the present invention demonstrating the function of the bleed hole connector when occlusion of the air tube lumen prevents air flow back through the tube and prevents normal deflation of the compressive garment.

Referring now to FIG. 4, a cross-sectional view of the bleed hole connector 120 of the present invention, its mating female quick-disconnect connector 116, air input tube 111 and air supply tube 110, respectively, similar to FIG. 3, is shown. Quick-disconnect connector 116 and bleed hole connector 120 are shown in their expanded view for clarity. Total occlusion of the air supply tube 110 and lumen 126 at a section 132 is shown. It is to be appreciated that such occlusion of medical and therapy device tubes can readily occur in regular use applications due to medical attendant's misplacement or inadvertent patient's movement with subsequent compression of or bending/kinking of the air supply tube 110. Normal deflation and inflation of compressive garment 106 (shown in FIGS. 1-2) by air to and from air pump 108 (shown in FIGS. 1-2) in directions 112 and 114, respectively, have ceased. The bleed hole connector 120 of the present invention is directly connected to compressive garment 106 through air input tube 111, and despite occlusion of aft tube lumen 126 at section 132, any trapped air in the garment 106 will move in direction 114 and dissipate through micro bleed hole 122 to prevent a possible situation of medical concern. Arrows 121 depict dissipative air flow through the bleed hole for clarity

ALTERNATIVE EMBODIMENTS

Figure 5:
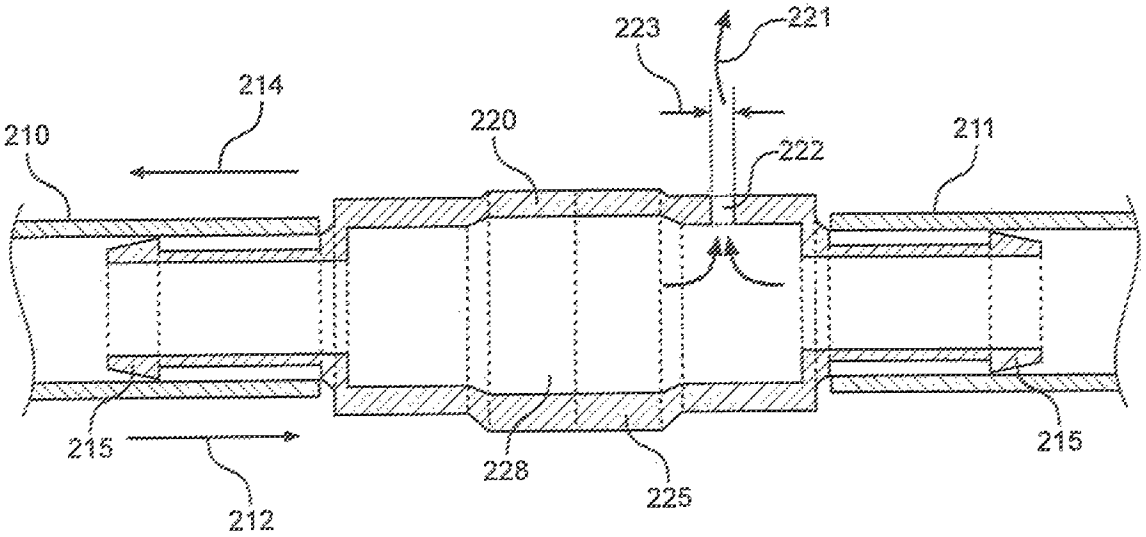
FIG. 5 is a cross-sectional view of an alternative application for the air tube of the IPC therapy device and an alternative embodiment of the micro bleed hole connector (shown as expanded from the standard female connector portion) of the present invention.

Now referring to FIG. 5, a cross-sectional view of an alternative embodiment of a bleed hole connector of the present invention is depicted and designated 220. Different shapes of the bleed hole connector 220 provide different tube attachment characteristics, which would be preferable for certain medical therapy applications known to those skilled in the art. The bleed hole connector 220 has a straight tubular construction with a hollow lumen 228, a central body 225, and hose barb sections 215 at both ends with an air supply tube 210 from an air pump (not shown in this Figure) attached to one end and an air input tube 211 of an intermittent pneumatic compression device garment (not shown) attached to the other end. A micro bleed hole 222 with a diameter 223 within the central body 225 connects the lumen 228 of bleed hole connector 220 with the outer atmosphere. During inflation and deflation of the intermittent pneumatic compression device garment, air flows through the air supply tube 210, the lumen 228 of bleed hole connector 220 and the air input tube 211 of the compressive garment in directions 212 and 214, respectively. A small amount of air also dissipates from lumen 228 through micro bleed hole 222, shown by directional arrows 221 for clarity.

It is to be appreciated that placement of the micro bleed hole 222 within the central body 225 of bleed hole connector 220 is not fixed, and may be appropriately determined based on a given medical therapy application known to those skilled in the art.

While there have been shown what are presently considered to be preferred embodiments and preferred applications of the present invention, it will be apparent to those skilled in the art that various changes and modifications can be made herein without departing from the scope and spirit of the invention.

We claim:

1. A micro bleed hole connector system for use in pneumatic compression devices comprising:

an air pump;

a compression garment having an inflatable bladder;

an air supply tube fluidly connected to the air pump;

an input tube fluidly connected to the bladder of the compression garment;

a first connector having:

a body having an internal lumen; and an aperture formed in the body in fluid communication with an ambient environment;

a second connector having a body with an internal lumen, the body of the second connector being configured to receive the body of the first connector; and a seal positioned between the first connector and the second connector, the seal configured to seal the first connector to the second connector when the first connected is received in the second connector, wherein when the first connector is received in the second connector and the first connector is sealed to the second connector by way of the seal, the aperture remains in fluid communication with the ambient environment to vent air to the ambient environment.

2. The micro bleed hole connector system for use in pneumatic compression devices of claim 1, wherein the body of the second connector further comprises a first end section including a quick-disconnect connector and a second end section including a hose barb connector.

3. The micro bleed hole connector system for use in pneumatic compression devices of claim 1, wherein the seal is an O-ring positioned in a groove in the body of the first connector.

4. The micro bleed hole connector system for use in pneumatic compression devices of claim 1, wherein when the first connector is received in the second connector, the aperture is covered by the body of the second connector but is not occluded thereby.

5. The micro bleed hole connector system for use in pneumatic compression devices of claim 1, wherein the body of the first connector includes a hose barb connector.

6. The micro bleed hole connector system for use in pneumatic compression devices of claim 1, wherein the internal lumen of the body of the second connector includes an internal lumen wall that defines the internal lumen, and when the first connector is received in the second connector, the seal engages the internal lumen wall and the body of the first connector so as to seal the first connector to the second connector.

7. The micro bleed hole connector system for use in pneumatic compression devices of claim 1, wherein the internal lumen of the second connector is configured to receive the body of the first connector.

8. The micro bleed hole connector system for use in pneumatic compression devices of claim 1, wherein the aperture has a diameter configured to permit inflation of the inflatable bladder of the compression garment and venting of air through the aperture during a deflation failure event.

9. A micro bleed hole connector system for use in pneumatic compression devices comprising:

an air pump;

a compression garment having an inflatable bladder;

an air supply tube fluidly connected to the air pump;

an input tube fluidly connected to the bladder of the compression garment;

a first connector having:

a body having an internal lumen; and an aperture formed in the body in fluid communication with an ambient environment;

a second connector having a body with an internal lumen, the body of the second connector being configured to receive the body of the first connector; and a seal positioned between the first connector and the second connector, the seal configured to seal the first connector to the second connector when the first connected is received in the second connector, wherein when the first connector is received in the second connector and the first connector is sealed to the second connector by way of the seal, the aperture remains in fluid communication with the ambient environment to vent air to the ambient environment, the aperture having a diameter configured to allow the compression garment to fully inflate when pressurized from the air pump and deflate if an air release path of the compression garment is occluded, thereby allowing the compression garment to depressurize to a safe pressure before blood stasis occurs.

10. The micro bleed hole connector system for use in pneumatic compression devices of claim 9, wherein the seal is an O-ring positioned in a groove in the body of the first connector.

11. The micro bleed hole connector system for use in pneumatic compression devices of claim 9, wherein when the first connector is received in the second connector, the aperture is covered by the body of the second connector but is not occluded thereby.

12. The micro bleed hole connector system for use in pneumatic compression devices of claim 9, wherein the body of the first connector includes a hose barb connector.

13. The micro bleed hole connector system for use in pneumatic compression devices of claim 9, wherein the internal lumen of the body of the second connector includes an internal lumen wall that defines the internal lumen, and when the first connector is received in the second connector, the seal engages the internal lumen wall and the body of the first connector so as to seal the first connector to the second connector.

14. The micro bleed hole connector system for use in pneumatic compression devices of claim 9, wherein the internal lumen of the second connector is configured to receive the body of the first connector.

15. The micro bleed hole connector system for use in pneumatic compression devices of claim 9, wherein the body of the second connector further comprises a first end section including a quick-disconnect connector and a second end section including a hose barb connector.

* * * * *